US006779903B2

(12) United States Patent
Segel

(10) Patent No.: US 6,779,903 B2
(45) Date of Patent: Aug. 24, 2004

(54) MULTI-STRUCTURE LIGHTING DEVICE

(75) Inventor: Daniel Segel, Loudonville, NY (US)

(73) Assignee: Sure Technologies, LLC, Troy, NY (US)

( * ) Notice: Subject to any disclaimer, the term of this patent is extended or adjusted under 35 U.S.C. 154(b) by 53 days.

(21) Appl. No.: 10/172,863

(22) Filed: Jun. 17, 2002

(65) Prior Publication Data

US 2003/0231484 A1 Dec. 18, 2003

(51) Int. Cl.[7] ..... F21K 2/00

(52) U.S. Cl. ..... 362/34; 101/225; 252/700; 206/219

(58) Field of Search ..... 362/84, 34, 101, 362/249, 217, 219, 225; 313/483; 252/700; 403/301

(56) References Cited

U.S. PATENT DOCUMENTS

| | | | | | |
|---|---|---|---|---|---|
| 3,813,534 | A | * | 5/1974 | Gilliam | 362/34 |
| 4,061,910 | A | | 12/1977 | Rosenfeld | 362/34 |
| 4,317,337 | A | | 3/1982 | Walden et al. | 63/3 |
| 4,712,165 | A | * | 12/1987 | Cetrone | 362/147 |
| 5,067,051 | A | | 11/1991 | Ladyjensky | 362/34 |
| 5,158,349 | A | * | 10/1992 | Holland et al. | 362/34 |
| 5,190,366 | A | | 3/1993 | World | 362/34 |
| 5,222,797 | A | | 6/1993 | Holland | 362/34 |
| 5,383,100 | A | | 1/1995 | Kikos | 362/34 |
| 5,390,086 | A | | 2/1995 | Holland | 362/34 |
| 5,454,661 | A | | 10/1995 | Litvin et al. | 403/298 |
| 5,508,893 | A | | 4/1996 | Nowak et al. | 362/34 |
| 5,628,557 | A | * | 5/1997 | Huang | 362/252 |
| 5,658,066 | A | * | 8/1997 | Hirsch | 362/219 |
| 5,702,176 | A | * | 12/1997 | Engle | 362/219 |
| 5,782,107 | A | | 7/1998 | Glanz | 63/3 |
| 5,836,778 | A | * | 11/1998 | Fan | 439/235 |
| 6,065,641 | A | * | 5/2000 | Laguna Valderrama | 222/80 |
| 6,079,842 | A | | 6/2000 | Cheng | 362/34 |
| 6,106,129 | A | | 8/2000 | Cranor et al. | 362/34 |
| 2003/0026089 | A1 | * | 2/2003 | Hsu | 362/103 |

* cited by examiner

*Primary Examiner*—Alan Cariaso
*Assistant Examiner*—Ali Alavi
(74) *Attorney, Agent, or Firm*—Ronald A. D'Alessandro; Hoffman, Warnick & D'Alessandro LLC

(57) ABSTRACT

A multi-structure lighting device. The lighting device includes multiple elongate structures that create a luminescent effect, and at least one connector. Each elongate structure is permanently affixed to another elongate structure by the connector. The connector can be a cross-shaped connector that includes ends that are inserted into the ends of chemiluminescent tubes thereby permanently affixing the tubes.

19 Claims, 2 Drawing Sheets

MULTI-STRUCTURE LIGHTING DEVICE

BACKGROUND OF THE INVENTION

1. Technical Field

This invention relates to a lighting device having a plurality of illuminating structures. More particularly, the invention provides a lighting device having at least one connector structure that permanently affixes the plurality of illuminating structures.

2. Background Art

Illuminating structures are well known. These structures have been used to add interest to children's toys and jewelry, create items for temporary lighting, and even as fishing lures. The use of chemiluminescent chemicals is one common method of creating an illuminating structure and is well known in the art. In these devices, a semi-translucent tube contains two chemicals. The mixture of the two chemicals creates a temporary lighting effect. To prevent the chemicals from mixing prematurely, the tube is filled with one of the chemicals, and ampules (frequently glass or plastic) that contain the second chemical are inserted into the tube. A user can then break the ampule to allow the chemicals to mix, generating the luminescent effect. Depending on the chemicals used, color of the tube, etc. different colors can be created. Various combinations of chemicals can be used to obtain a desired color and are discussed, for example, in U.S. Pat. No. 4,061,910 issued on Dec. 6, 1977.

Multiple colors may be desired to further add interest or functionality to a particular illuminating structure. In this case, barriers are frequently inserted into the tube that separate multiple ampules that contain different chemicals in order to generate the different colors. The barriers prevent the various chemicals from mixing, which would lessen the creation of distinct color areas. However, this adds a great deal of complexity to the manufacturing process since the various fluids, ampules, and barriers must be alternately inserted into a tube. When several color schemes are desired, the complexity is further increased.

Alternatively, tubes of varying colors have been inserted into a structure having recesses that subsequently hold the tubes in place. However, using this process does not allow for a substantially uniform structure (e.g., an elongated rod having multiple colors) because the recesses must be of a wider diameter than the tubes to be inserted. Further, because of the circular design, the tubes may be prone to fall out.

As a result, there exists a need for a lighting device that includes a plurality of elongate structures that create a luminescent effect, and at least one connector for permanently affixing the elongate structures together. The connector can be such that it forms a contiguous surface with the elongate structures.

SUMMARY OF THE INVENTION

The current invention provides a lighting device that includes multiple elongate structures, that each create a luminescent effect, and a connector that permanently attaches the elongate structures, forming a larger structure.

A first aspect of the invention provides a lighting device, comprising: a plurality of elongate structures, wherein each of the plurality of elongate structures includes a first end and a second end, and wherein each of the plurality of elongate structures creates a luminescent effect; and at least one connector, wherein the at least one connector permanently affixes an end of a first elongate structure to an end of a second elongate structure.

A second aspect of the invention provides a lighting device, comprising: a plurality of tubes, each of the plurality of tubes including: a first end; a second end; a first solution within each tube; and an ampule within the first solution containing a second solution, wherein each ampule is breakable to allow the first solution to mix with the second solution to create a luminescent effect; at least one connector, the at least one connector including: a first protrusion for insertion into the first end of a first tube; a second protrusion for insertion into the first end of a second tube, wherein the at least one connector permanently affixes the first end of a first tube to the first end of a second tube and wherein the at least one connector forms a contiguous surface with the first tube and the second tube.

A third aspect of the invention provides a lighting device, comprising: a plurality of hollow elongate structures, wherein each of the plurality of elongate structures includes: an inner chamber; a first end having a first barrier element disposed within the inner chamber; a second end having a second barrier element disposed within the inner chamber; a first solution disposed between the first barrier element and the second barrier element within the inner chamber; and an ampule within the first solution containing a second solution, wherein the ampule is breakable to allow the first solution to mix with the second solution to create a luminescent effect; and at least one connector, wherein the at least one connector permanently affixes an end of a first elongate structure to an end of a second elongate structure.

The exemplary aspects of the present invention are designed to solve the problems herein described and other problems not discussed, which are discoverable by a skilled artisan.

BRIEF DESCRIPTION OF THE DRAWINGS

These and other features of this invention will be more readily understood from the following detailed description of the various aspects of the invention taken in conjunction with the accompanying drawings in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

The current invention provides a lighting device that includes a plurality of elongate structures that each creates a luminescent effect, and at least one connector that permanently affixes the elongate structures to form the lighting device.

Figure 1:
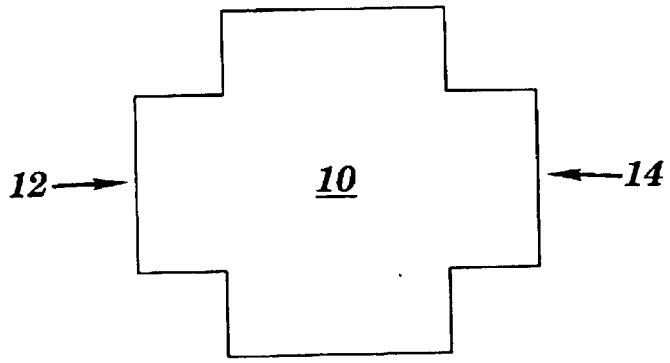
FIG. 1 depicts a cross-section of a connector according to one aspect of the invention.

Turning to FIG. 1, a cross-section of an exemplary connector 10 is shown. Connector 10 has a first protrusion 12 and a second protrusion 14 that each permanently affixes to an end of an elongate structure. While first protrusion 12 is shown opposing second protrusion 14, it is understood that first protrusion 12 and second protrusion 14 can be disposed in any relation to each other. Further it is understood that connector 10 can comprise more than two protrusions for permanently affixing ends of elongate structures, and can affix any number of elongate structures in any relation to each other.

Figure 2:
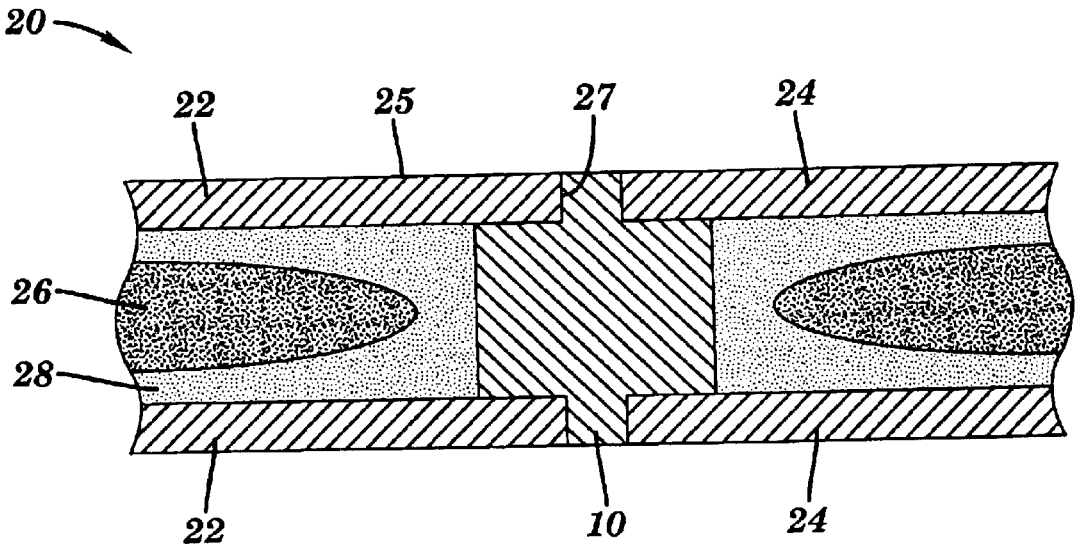
FIG. 2 depicts a cross-section of a portion of a lighting device according one aspect of the invention.

FIG. 2 shows a portion of a lighting device 20 that comprises a first elongate structure 22 and a second elongate structure 24 permanently affixed by connector 10. When attached, connector 10 can form a contiguous outer surface 25 with elongate structures 22, 24. Alternatively, connector 10 can have an outer surface unique from elongate structures 22, 24. For example, connector 10 can include bumps for gripping lighting device 20, form a widened portion of lighting device 20, etc. Connector 10 can be attached to the surface of inner chamber 26 and/or end 27 of each elongate structure 22, 24 using any means now known or later developed, including: an adhesive, fusion, etc.

While connector 10 is shown having a relative size and shape when compared with elongate structures 22, 24, it is understood that this size and shape is only exemplary, and the invention is not limited to any particular size or shape of connector 10. Similarly, elongate structures 22, 24 can have any desired shape. For example, elongate structures 22, 24 can be tubular, rectangular, triangular, etc. Further, elongate structures 22, 24 can be any width, and can have different widths. Elongate structures 22, 24 can also have an inner chamber 26 or be solid.

Each elongate structure 22, 24 creates a luminescent effect. For example, elongate structures 22, 24 can be translucent and configured to create a chemiluminescent effect. Elongate structures 22, 24 are shown having an inner chamber 26 and an ampule 28 disposed therein. Inner chamber 26 can also contain a first solution, and ampule 28 can contain a second solution. Ampule 28 can be breakable to allow the first solution to mix with the second solution to create the luminescent effect when desired. Various combinations of solutions can be used to generate the desired luminescent effect. Further, each elongate structure 22, 24 can include different solutions to generate a different luminescent effect (i.e., a unique color). Additionally, elongate structures can comprise different colors (e.g., tinting) to vary the luminescent effect.

While elongate structures 22, 24 are shown using the chemiluminescent effect described above, it is understood that elongate structures 22, 24 can create the luminescent effect using any means now known or later developed. Similarly, connector 10 can also create its own luminescent effect and/or propagate the luminescent effect generated by elongate structures 22, 24 using any means.

Figure 3:
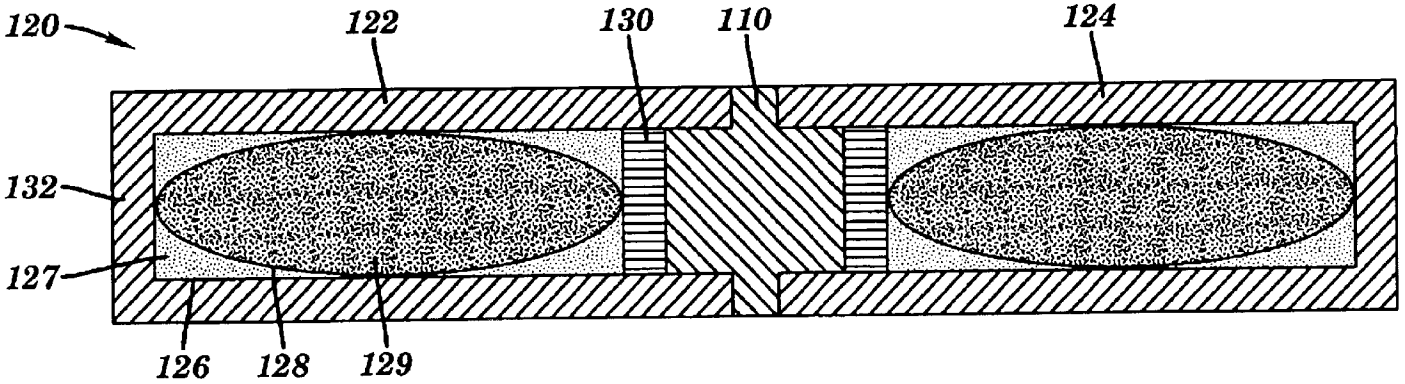
FIG. 3 depicts a cross-section of a lighting device according to another aspect of the invention.

As shown in FIG. 2, connector 10 acts as a barrier to trap the first solution and ampule 28 within inner chamber 26 of elongate structures 22, 24. Alternatively, FIG. 3 depicts a lighting device 120 comprising elongate structures 122, 124 and connector 110. Similar to FIG. 2, each elongate structure includes an inner chamber 126 containing a first solution 127 and an ampule 128 containing a second solution 129. However, each elongate structure 122, 124 in FIG. 3 further includes a barrier element 130.

Barrier element 130 can be used to trap first solution 127 and ampule 128 within inner chamber 126. Barrier element 130 can be permanently affixed to the surface of inner chamber 126 using any means, including; an adhesive, fusion, etc. Alternatively, barrier element 130 can be placed in the desired position and secured by conforming to the shape of inner chamber 126. When barrier element 130 is permanently affixed to elongate structure 122, 124, connector 110 can be permanently affixed to barrier element 130 in addition to, or alternative to being permanently affixed to elongate structures 122, 124 using any means as described above.

Figure 4:
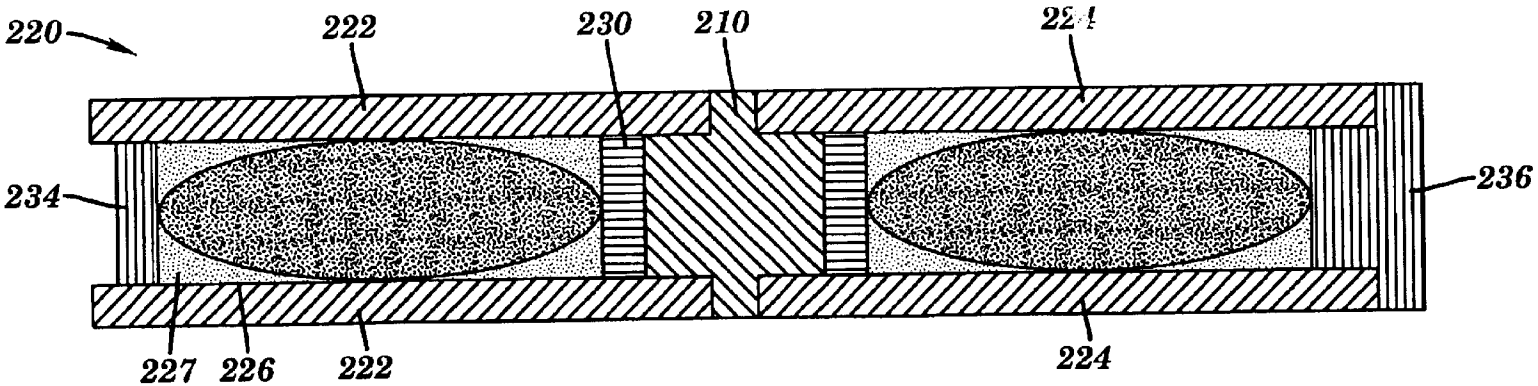
FIG. 4 depicts a cross-section of a lighting device according to yet another aspect of the invention.

Elongate structures 122, 124 are shown having a closed end 132 for trapping first solution 127 and ampule 128 on the non-affixed end. Alternatively, FIG. 4 shows a lighting device 220 having elongate structures 222, 224 with barrier elements 230, 234, 236 for trapping a first solution 227 and ampule 228 within inner chamber 226. Barrier element 234 is configured to allow an additional connector 210 to be affixed to the end, while barrier element 236 is configured to provide similar surface as a closed end. While lighting devices 120, 220 are shown having elongate structures having either an open end with a barrier and a closed end or two open ends with barriers, it is understood that a lighting device can include any combination of elongate structures. For example, a lighting device having three elongate structures affixed in a row by two connectors may use two elongate structures having a closed end for each end elongate structure, and an elongate structure having two open ends for the center elongate structure.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of the invention as defined by the accompanying claims.

What is claimed is:

1. A lighting device, comprising:

a plurality of elongate structures, wherein each of the plurality of elongate structures includes a first end and a second end, and wherein each of the plurality of elongate structures creates a luminescent effect; and at least one connector, wherein the at least one connector permanently affixes an end of a first elongate structure to an end of a second elongate structure by means of a first protrusion for inserting into the end of the first elongate structure and a second protrusion, opposing the first protrusion, for inserting into the end of the second elongate structure, wherein each of the plurality of elongate structures is translucent and further includes an inner chamber having: a first solution disposed therein; and an ampule within the first solution containing a second solution, wherein the ampule is breakable to allow the first solution to mix with the second solution to create the luminescent effect.

2. The lighting device of claim 1, wherein the inner chamber further has a barrier element disposed within the first end and a barrier element disposed within the second end for trapping the first solution and the ampule within the inner chamber.

3. The lighting device of claim 1, wherein the at least one connector traps the first solution and the ampule within the inner chamber on the affixed end of the first elongate structure and the affixed end of the second elongate structure.

4. The lighting device of claim 1, wherein one end of each of the plurality of elongate structures is closed.

5. The lighting device of claim 1, wherein the at least one connector is permanently affixed to the inner chamber of each of the plurality of elongate structures.

6. The lighting device of claim 5, wherein the at least one connector is permanently affixed using at least one of: an adhesive, and fusion.

7. The lighting device of claim 1, wherein the luminescent effect created by each of the plurality of elongate structures is a unique color.

8. The lighting device of claim 1, wherein the at least one connector forms a contiguous outer surface with the plurality of elongate structures.

9. A lighting device, comprising:

a plurality of tubes, each of the plurality of tubes including:

a first end;

a second end;

a first solution within each tube;

an ampule within the first solution containing a second solution, wherein each ampule is breakable to allow the first solution to mix with the second solution to create a luminescent effect;

at least one connector, the at least one connector including:

a first protrusion for inserting into the first end of a first tube; and a second protrusion for inserting into the first end of a second tube, wherein the at least one connector permanently affixes the first end of a first tube to the first end of a second tube and wherein the at least one connector forms a contiguous outer surface with the first tube and the second tube.

10. The lighting device of claim 9, wherein the end of each of the plurality of tubes that is not affixed is closed.

11. The lighting device of claim 10, wherein the at least one connector further traps the first solution and the ampule within each tube on the affixed end of each of the plurality of tubes.

12. The lighting device of claim 10, wherein each tube further comprises a barrier element disposed within the affixed end for trapping the first solution and the ampule within each tube.

13. The lighting device of claim 9, wherein each tube further comprises a barrier element disposed within the first end and a barrier element disposed within the second end for trapping the first solution and the ampule within each tube.

14. The lighting device of claim 9, wherein the second end of the at least one connector opposes the first end of the at least one connector.

15. A lighting device, comprising:

a plurality of hollow elongate structures, wherein each of the plurality of elongate structures includes:

an inner chamber;

a first end having a first barrier element disposed within the inner chamber;

a second end having a second barrier element disposed within the inner chamber;

a first solution disposed between the first barrier element and the second barrier element within the inner chamber; and an ampule within the first solution containing a second solution, wherein the ampule is breakable to allow the first solution to mix with the second solution to create a luminescent effect; and at least one connector, wherein the at least one connector permanently affixes an end of a first elongate structure to an end of a second elongate structure, the at least one connector including:

a first protrusion for inserting into the first end of a first elongate structure; and a second protrusion for inserting into the first end of a second elongate structure.

16. The lighting device of claim 15, wherein each barrier element is permanently affixed to the inner chamber.

17. The lighting device of claim 16, wherein the at least one connector is permanently affixed to the first barrier element.

18. The lighting device of claim 15, wherein the at least one connector is permanently affixed to the inner chamber.

19. A lighting device, comprising:

a plurality of elongate structures, wherein each of the plurality of elongate structures includes a first end and a second end, and wherein each of the plurality of elongate structures creates a luminescent effect, and wherein each of the plurality of elongate structures is translucent and further includes an inner chamber having:

a first solution dispersed therein; and an ampule within the first solution containing a second solution, wherein the ampule is breakable to allow the first solution to mix with the second solution to create the luminescent effect; and at least one connector, wherein the at least one connector permanently affixes an end of a first elongate structure to an end of a second elongate structure, and wherein the at least one connector traps the first solution and the ampule within the inner chamber on the affixed end of the first elongate structure and the affixed end of the second elongate structure.

* * * * *